US011017697B2

(12) United States Patent
Sharp

(10) Patent No.: US 11,017,697 B2
(45) Date of Patent: May 25, 2021

(54) VISUAL DISPLAY DEVICE WITH BEAD TRANSPORT CONTROL

(71) Applicant: Gordon Sharp, Newton, MA (US)

(72) Inventor: Gordon Sharp, Newton, MA (US)

(73) Assignee: Airflow Kinetics, LLC, Newton, MA (US)

( * ) Notice: Subject to any disclaimer, the term of this patent is extended or adjusted under 35 U.S.C. 154(b) by 0 days.

(21) Appl. No.: 16/560,925

(22) Filed: Sep. 4, 2019

(65) Prior Publication Data

US 2021/0065592 A1 Mar. 4, 2021

(51) Int. Cl.

| | |
|---|---|
| ***G09F 19/12*** | (2006.01) |
| ***G10K 15/04*** | (2006.01) |
| *G09F 27/00* | (2006.01) |

(52) U.S. Cl.

CPC ..... *G09F 19/12* (2013.01); *G10K 15/04* (2013.01); *G09F 27/00* (2013.01)

(58) Field of Classification Search

CPC ..... G09F 19/12; G09F 19/02; G09F 27/00
See application file for complete search history.

(56) References Cited

U.S. PATENT DOCUMENTS

| | | | | |
|---|---|---|---|---|
| 4,215,500 | A * | 8/1980 | Sharp | G09F 19/02 40/409 |
| 5,291,674 | A * | 3/1994 | Torrence | G09F 19/02 40/410 |
| 5,794,364 | A | 8/1998 | Richmond | |
| 6,502,337 | B1 * | 1/2003 | Ochi | G09F 19/02 40/406 |
| 6,550,169 | B1 | 4/2003 | Sena et al. | |
| 7,302,767 | B2 * | 12/2007 | McKnight | B44C 5/00 40/409 |
| 7,963,057 | B1 | 6/2011 | Ruiz | |
| 8,347,534 | B2 | 1/2013 | Ruiz | |

* cited by examiner

*Primary Examiner* — Gary C Hoge
(74) *Attorney, Agent, or Firm* — Morse, Barnes-Brown & Pendleton, P.C.; Lisa M. Warren, Esq.

(57) ABSTRACT

A visual display device creating various visual and audible effects from the motion of light particulate matter, such as beads of expanded polystyrene, comprising a chamber through which a stream of air flow is configured to agitate, fluidize, suspend, or float at least some of the beads. The device also includes a bead transport control subsystem to control the flow of some beads through a conduit from one region of a chamber in the device to another different region in the chamber of the visual display device. The bead transport control subsystem comprises the conduit and a second stream of airflow into or out of a portion of the conduit through a screened opening to prevent or create fluid-like flow of the beads through the conduit that is controlled at least partially independently from the first stream of airflow.

13 Claims, 11 Drawing Sheets

VISUAL DISPLAY DEVICE WITH BEAD TRANSPORT CONTROL

FIELD OF THE INVENTION

This invention relates broadly to the field of kinetic art and visual effect display devices used for home or commercial art installations and more specifically to the control of the movement of light particulate matter such as expanded polystyrene beads or spheres from one area of a visual display device to another area of the visual display device. The visual display device has a fixed or variable first source of air flowing through the device to create various different visual effects. The bead transport control system is implemented without using any mechanical obstruction means in the path of the beads but relies instead on the control of a second source of airflow into or out of a conduit at a location or locations where it can impact the transport of the beads.

BACKGROUND OF THE INVENTION

This invention relates to an improvement on a prior patented invention described in U.S. Pat. No. 4,215,500 to Sharp which is incorporated herein by reference. This patent discloses a visual display device that uses the principle of a fluidized bed to create interesting visual and audible affects from the motion of beads of expanded polystyrene or similar materials in a stream of flowing air. This patent involves fluidization of the beads but has only one column and no conduit or second column to move beads from one area of the column to another. There is also no means to dynamically or automatically vary the number of beads in the column.

Subsequent prior art to this invention includes U.S. Pat. No. 7,302,767 to McKnight However, the patent does not disclose any means to control the flow of beads down a return column. The beads flow continuously around the unit and there is no means to stop or control this recirculating flow other than of course to shut down the entire unit or vary the airflow in both columns. The patent as such discloses only one source of airflow that is moving the beads. Furthermore, no means are disclosed to control the number of beads in at least one of the columns to vary the effects in that column. Beads at the bottom of the display device also move from the outer column to the inner column by the Venturi effect. However, the venturi effect for moving beads is only effective over a short relative distance and no means are disclosed to provide independent or a second control means for the number of beads moved or their flowrate from one column into the other.

Additional prior art consists of U.S. Pat. No. 7,963,057 B1 and U.S. Pat. No. 8,347,534 B2 both awarded to Ruiz. This patent like McKnight uses a Venturi effect to pull beads from a horizontal collection platform into the bead discharge nozzle so they can be propelled into the air. Similar to McKnight there is no independent controlled airflow, second stream of airflow, or other means disclosed to vary or dynamically control the flowrate of beads into the bead discharge nozzle separate in some way from the main airflow control and the venturi affect will only operate over a short distance.

Another prior art patent of a visual display device consists of U.S. Pat. No. 6,550,169 B1 to Sena which is incorporated herein by reference. This patent discloses a novelty display with a fan wherein beads move by gravity and the fan's suction force into the inlet of the fan. The fan then blows them up into and through a tube where they fall back into the viewable portion of the display unit. This patent again only discloses one means of moving the beads through the unit, in this case by a fan. The flow of the beads into this fan is partially through gravity from a sloping ramp. Once the beads are close enough to the fan inlet the fan's suction force will pull them into the fan itself. There is nothing disclosed to slow or stop the movement of beads or their flowrate into the fan to control the number beads on the ramp or at the bottom of the unit. There is no means disclosed to independently control or at least provide some partially independent control of the number of beads in one area of the display unit. Also, the means disclosed to move the beads through the unit involves running the beads through the fan itself. For a unit that may run for long periods of time this has a significant disadvantage since the fan blades and the interaction of the blades spinning in a housing over time will damage and or crush the beads. Although this may or may not happen often, over time the number of beads that become damaged and or crushed by the mechanical movement of the blades in the housing will cumulatively become a large number affecting and degrading the overall appearance of the visual display. As such maintenance may be required on a frequent basis to replace the damaged beads which may be difficult, expensive, and time consuming particularly on a larger unit.

Finally, prior art U.S. Pat. No. 5,794,364 awarded to Richmond, discloses a means of launching spherical projectiles such as balloons from a vertical chute. These round projectiles fall back to a sloping, concave surface and roll back to the vertical chute where they are launched over and over again. Like the last patent, a sloping surface and gravity is the primary means for moving objects of the invention to an upward moving airstream. Again, as in Sena and other prior art, there is no independent or partially independent ability to control the flowrate of the object's movement up into the vertical airstream or stop this movement entirely without adjusting the speed of the launching action itself or turning off the device completely.

There is a need to be able to dynamically and automatically vary the bead amounts and movement in columns to automatically vary the visual effects. For this, and to create other visual effects such as of movement of the beads from one area of the visual display device to another area and to freeze beads in areas of the visual display device, there is a need to be able to move all or a portion of the beads into another column or contained space or a different portion of the same column or contained space. There is also a need to control the movement of the beads with minimal crushing of the beads in fan blades or other airflow surfaces such as dampers.

SUMMARY OF THE INVENTION

It is therefore an object of this invention to provide a visual display device, system, and method comprising a bead transport control subsystem for moving beads with minimal damage through a conduit or enclosed space from one area of the visual display device to another at a flow rate or speed that can be varied and automatically controlled using a second stream of airflow that can be controlled separate from a first air flow stream that is used to provide the primary means to fluidize and move the beads for the main visual effects. In some embodiments the second stream of airflow may be affected or influenced to various degrees by the first air stream but the second stream of airflow will still have some independent or partially independent second airflow control approach such as through fans, dampers or other airflow control approaches to still allow control and achievement of a desired second flow rate. The phrase "partially independent airflow control" and the like refers to control of an airflow stream by one or more airflow control devices that may also be impacted by a second airflow controlled by one or more separate airflow control devices. In other words, in some embodiments, one or more airflow control devices only partially control an airflow stream. However, even though an airflow control approach may affect to some preferably lesser extent another airflow stream, as long as least two different airflow control devices are used to control at least two different airflow streams then each airflow stream can be set to different values (at least with a range of possible values) by the proper control settings of the two different airflow control devices. Thus, even if the second stream of airflow is controlled at least partially independently from said first stream of airflow, each airflow stream can still be set to two different desired values. In some embodiments, once the first airflow stream's volume is set through a fan or damper setting, the second air flow can be easily adjusted to its desired value with little or no impact on the first airflow stream. In other embodiments the control of both of the two airflow streams can be done independently with little to no impact on each other (e.g., independent airflow control).

Some aspects of the present disclosure are related to a visual display device (e.g., 100) for creating various visual and, optionally, audible effects from motions of a plurality of beads (e.g., 170, 270), the visual display device (e.g., 100) comprising a chamber with at least some portion of the chamber configured to provide a view of an interior of the chamber, and comprising a primary flow subsystem comprising a first stream of airflow configured to agitate, fluidize, suspend, or float at least some of said plurality of beads (e.g., 170, 270); and a bead transport control subsystem comprising a second stream of airflow controlling a flow of at least a portion of said plurality of beads (e.g., 170, 270) through at least one conduit (e.g., 101, 103, 151, 180, 201) connecting a first region of the chamber to a second region of the chamber; wherein said second stream of airflow is controlled at least partially independently from said first stream of airflow. In some embodiments, said plurality of beads (e.g., 170, 270) comprise lightweight expanded polystyrene plastic beads (e.g., 170, 270). In some embodiments, the visual display device (e.g., 100) further comprises a screened opening (e.g., 104-107, 112-114, 155, 202) disposed within at least a wall or end of said at least one conduit (e.g., 101, 103, 151, 180, 201). In some embodiments, said second stream of airflow passes into or out of said at least one conduit (e.g., 101, 103, 151, 180, 201) through said screened opening (e.g., 104-107, 112-114, 155, 202). In some embodiments, one or more fans (e.g., 12, 23, 25, 153-154, 204) are configured to vary at least a volume of said second stream of airflow.

In some embodiments, the visual display device (e.g., 100) further comprises one or more dampers (e.g., 11, 13, 15, 120, 181, 207, 303) configured to vary at least a volume of said second stream of airflow. In some embodiments, the visual display device (e.g., 100) further comprises an airflow control device configured to control at least a volume of said second stream of airflow, wherein said second stream of airflow flows out of said at least one conduit (e.g., 101, 103, 151, 180, 201) through said screened opening (e.g., 104-107, 112-114, 155, 202); and a first subset of said plurality of beads (e.g., 170, 270) are pulled against or are frozen in place said screened opening (e.g., 104-107, 112-114, 155, 202) such that the first subset of said plurality of beads (e.g., 170, 270) stops or restricts a flow of a second subset of said plurality of beads (e.g., 170, 270) through said at least one conduit (e.g., 101, 103, 151, 180, 201).

In some embodiments, the visual display device (e.g., 100) further comprises an airflow control device configured to control at least a volume of said second stream of airflow, wherein said second stream of airflow flows into said at least one conduit (e.g., 101, 103, 151, 180, 201) through said screened opening (e.g., 104-107, 112-114, 155, 202); and said second stream of airflow is configured to fluidize or cause said plurality of beads (e.g., 170, 270) to move through said at least one conduit (e.g., 101, 103, 151, 180, 201). In some embodiments, the screened opening (e.g., 104-107, 112-114, 155, 202) is on a bottom wall or bottom end of said at least one conduit (e.g., 101, 103, 151, 180, 201).

In some embodiments, said at least one conduit (e.g., 101, 103, 151, 180, 201) comprises a first hollow column (e.g., 101-103) connected to a second hollow column (e.g., 101-103) disposed within the chamber through a connecting opening (e.g., 109, 110, 115, 116) disposed between said first hollow column (e.g., 101-103) and said second hollow column (e.g., 101-103) that is in in fluid communication with said screened opening (e.g., 104-107, 112-114, 155, 202) disposed in said first hollow column (e.g., 101-103) such that control of said second stream of airflow controllably prevents or creates a bead flow between said first hollow column (e.g., 101-103) and said second hollow column (e.g., 101-103) through said connecting opening (e.g., 109, 110, 115, 116).

In some embodiments, the visual display device (e.g., 100) further comprises an airflow control device configured to control said second stream of airflow into or out of said at least one conduit (e.g., 101, 103, 151, 180, 201) through said screened opening (e.g., 104-107, 112-114, 155, 202), wherein said airflow control device comprises a first damper (e.g., 11, 13, 15, 120, 181, 207, 303) having a first end connected to an at least partially enclosed space and also connected to an outlet of a fan (e.g., 12, 23, 25, 153-154, 204) wherein a second end of said first damper (e.g., 11, 13, 15, 120, 181, 207, 303) is configured to blow at least a portion of outlet airflow of said fan (e.g., 12, 23, 25, 153-154, 204) into said at least one conduit (e.g., 101, 103, 151, 180, 201) through said screened opening as said second stream of airflow; and a second damper (e.g., 11, 13, 15, 120, 181, 207, 303) having a first end connected to an at least partially enclosed space and also connected to an inlet of said fan (e.g., 12, 23, 25, 153-154, 204) wherein a second end of said second damper (e.g., 11, 13, 15, 120, 181, 207, 303) is configured to pull said second stream of airflow out of said at least one conduit (e.g., 101, 103, 151, 180, 201) through said screened opening into the inlet said fan (e.g., 12, 23, 25, 153-154, 204).

In some embodiments, the visual display device (e.g., 100) further comprises two or more airflow control devices wherein at least a first airflow control device of the two or more airflow control devices is configured to control said first stream of airflow and at least a second airflow control device of the two or more airflow control devices is configured to control said second stream of airflow. In some embodiments, said first airflow control device is further configured to exert additional control on said second stream of airflow and said second airflow control device is further configured to exert additional control on said first stream of airflow.

Some aspects of the present disclosure are related to a visual display apparatus (e.g., 200) for creating various visual and, optionally, audible effects from motions of a plurality of beads (e.g., 170, 270), the visual display apparatus (e.g., 200) comprising a chamber with at least some portion of the chamber configured to provide a view of an interior of the chamber, and comprising a primary flow subsystem comprising a first stream of airflow configured to agitate, fluidize, suspend, or float at least some of said plurality of beads (e.g., 170, 270); and a bead transport control subsystem comprising a second stream of airflow controlling a flow of at least a portion of said plurality of beads (e.g., 170, 270) through at least one conduit (e.g., 101, 103, 151, 180, 201) connecting a first region of the chamber to a second region of the chamber; and at least two airflow control devices comprising at least one first airflow control device configured to set said first stream of airflow to a first desired airflow volume value and at least one second airflow control device configured to set said second stream of airflow to a second desired airflow volume value. In some embodiments, said plurality of beads (e.g., 170, 270) comprise lightweight expanded polystyrene plastic beads (e.g., 170, 270). In some embodiments, the visual display apparatus (e.g., 200) further comprises a screened opening (e.g., 104-107, 112-114, 155, 202) disposed within at least a wall or end of said at least one conduit (e.g., 101, 103, 151, 180, 201); wherein said second stream of airflow passes into or out of said at least one conduit (e.g., 101, 103, 151, 180, 201) through said screened opening. In some embodiments, said screened opening is on a bottom wall or bottom end of said at least one conduit (e.g., 101, 103, 151, 180, 201). In some embodiments, said at least one conduit (e.g., 101, 103, 151, 180, 201) comprises a first hollow column (e.g., 101-103) connected to a second hollow column (e.g., 101-103) disposed within the chamber through a connecting opening (e.g., 109, 110, 115, 116) disposed between said first hollow column (e.g., 101-103) and said second hollow column (e.g., 101-103) that is in fluid communication with said screened opening (e.g., 104-107, 112-114, 155, 202) disposed in said first hollow column (e.g., 101-103) such that control of said second stream of airflow controllably prevents or creates a bead flow between said first hollow column (e.g., 101-103) and said second hollow column (e.g., 101-103) through said connecting opening (e.g., 109, 110, 115, 116). In some embodiments, the visual display apparatus (e.g., 100, 200, 300, 400) further comprises a shelf (e.g., 111, 205) of solid material configured to block a flow of said plurality of beads (e.g., 170, 270) through a portion of said at least one conduit (e.g., 101, 103, 151, 180, 201), wherein said shelf (e.g., 111, 205) is configured to interact with said screened opening (e.g., 104-107, 112-114, 155, 202) so as to initiate formation of a plug of beads (e.g., 170, 270) in said at least one conduit (e.g., 101, 103, 151, 180, 201) to restrict or block a flow of said plurality of beads (e.g., 170, 270) through said at least one conduit (e.g., 101, 103, 151, 180, 201).

In some embodiments, said second airflow control device comprises a first fan (e.g., 12, 23, 25, 153-154, 204) comprising an axial fan type or a computer cooling fan type, configured to pull air out of said at least one conduit (e.g., 101, 103, 151, 180, 201); a second fan (e.g., 12, 23, 25, 153-154, 204) comprising an axial fan type or computer cooling fan type, configured to blow air into said at least one conduit (e.g., 101, 103, 151, 180, 201), wherein said first fan (e.g., 12, 23, 25, 153-154, 204) and said second fan (e.g., 12, 23, 25, 153-154, 204) are mounted in series with each other so that an outlet of said first fan (e.g., 12, 23, 25, 153-154, 204) faces an outlet of said second fan (e.g., 12, 23, 25, 153-154, 204) or an inlet of said first fan (e.g., 12, 23, 25, 153-154, 204) faces an inlet of said second fan (e.g., 12, 23, 25, 153-154, 204), and wherein a set of fans (e.g., 12, 23, 25, 153-154, 204) comprising said first fan (e.g., 12, 23, 25, 153-154, 204) and said second fan (e.g., 12, 23, 25, 153-154, 204) is configured with respect to said screened opening (e.g., 104-107, 112-114, 155, 202) of said at least one conduit (e.g., 101, 103, 151, 180, 201) so that said set of fans (e.g., 12, 23, 25, 153-154, 204) is configured to either pull air out of said at least one conduit (e.g., 101, 103, 151, 180, 201) or blow air into said at least one conduit (e.g., 101, 103, 151, 180, 201).

In one preferred embodiment, a side column (e.g., 101, 103) is adjacent to a main column (e.g., 102). This side column is used to store beads from the main column to dynamically adjust the number of beads in the main column. Near the bottom of the side column is an opening (e.g., 109, 110) connecting the two columns together. By either blowing air into the bottom of the side column or exhausting air out of the bottom of the side column, the beads in the side column can be made to either flow into the main column or be frozen in place and prevented from flowing into the main column.

In another preferred embodiment, a screened opening (e.g., 107) on the vertical wall of the side column has a damper (e.g., 120) connected to and covering the opening. By opening the damper, airflow will flow out of the side of the column. If this airflow is high enough, beads will be pulled against the screen and accumulate there. In some embodiments, a plug of beads (e.g., 270) can be used to block the side column so no beads will pass through it.

In another preferred embodiment, a column (e.g., 102) is absent, with columns (e.g., 101, 103) connected by a conduit (e.g., 180, 201).

It is another object of the invention to be able to transport beads through a horizontal or sloping conduit to pass beads from one area of the visual display to another. This can be accomplished by having the bottom of the conduit made up at least partially of a screened opening (e.g., 202) through which airflow is passed either into or out of the conduit. A positive airflow into the conduit that is not excessive will fluidize the beads and allow them to move through the horizontal conduit. Exhausting air out of the conduit through the screened opening will pull the beads against the screen and stop them from moving through the conduit.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

Figure 1:
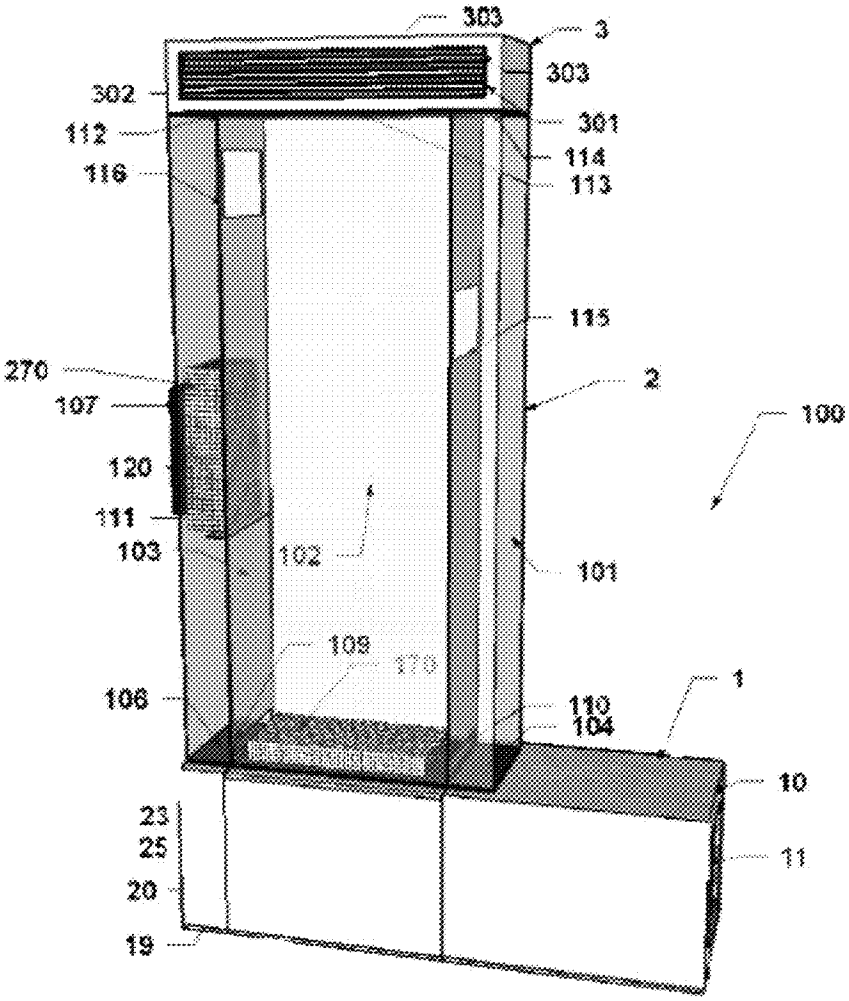
FIG. 1 is a view of a typical embodiment of the visual display device (100) composed of a base, column, and top cap assemblies.

To provide an overall understanding, certain illustrative embodiments will now be described; however, it will be understood by one of skill in the art that the apparatus, systems and methods described herein can be adapted and modified to provide devices, systems and methods for other suitable applications and that other additions and modifications can be made without departing from the scope of the systems and methods described herein.

FIGS. 1-11, wherein like parts are designated by like reference numerals throughout, illustrate an example embodiment or embodiments of a visual display device, system, method and apparatus for providing audiovisual effects to observers using the flow or motion of particulate matter, such as beads made of expanded polystyrene, according to the present invention. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed, such as the size, shape, or type of elements or materials, in a manner still in keeping with the spirit and scope of the present invention.

Figure 2:
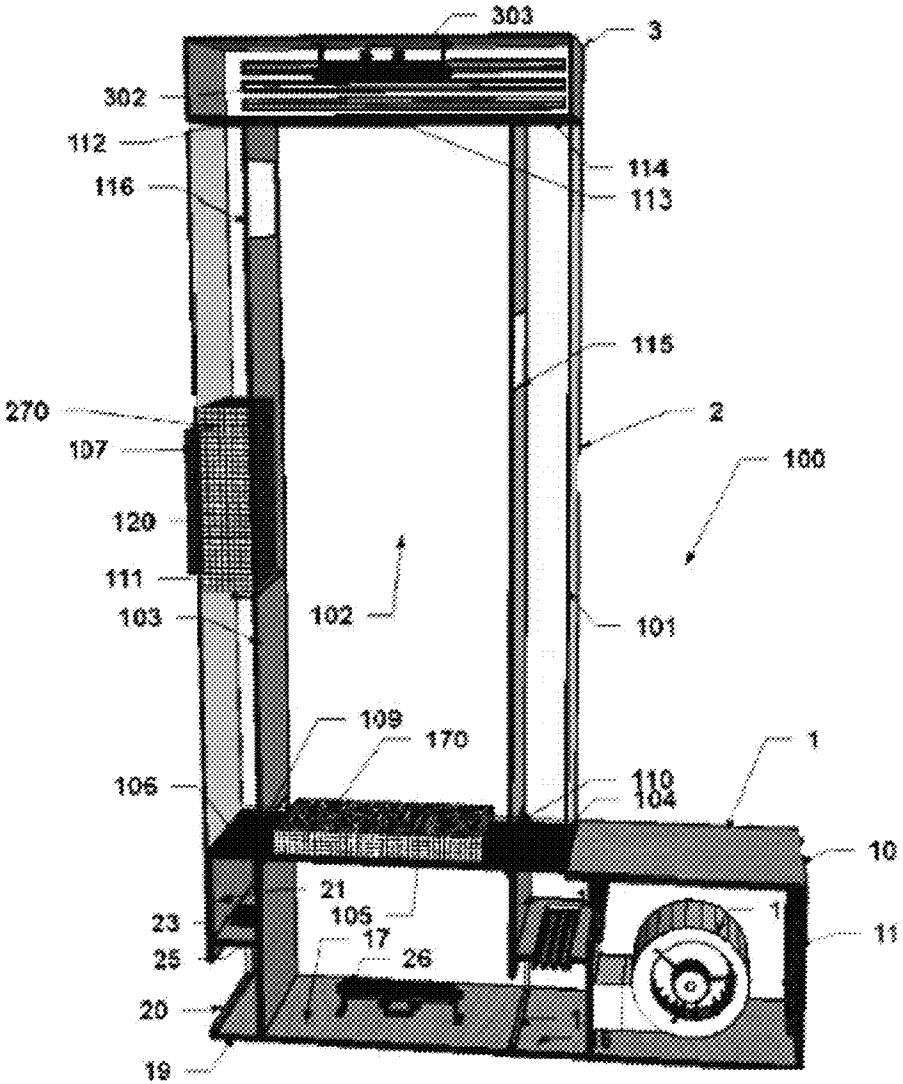
FIG. 2 is a front sectional view of a typical embodiment of the visual display device that shows details of the inside of the base, column and top cap assemblies.
Figure 3:
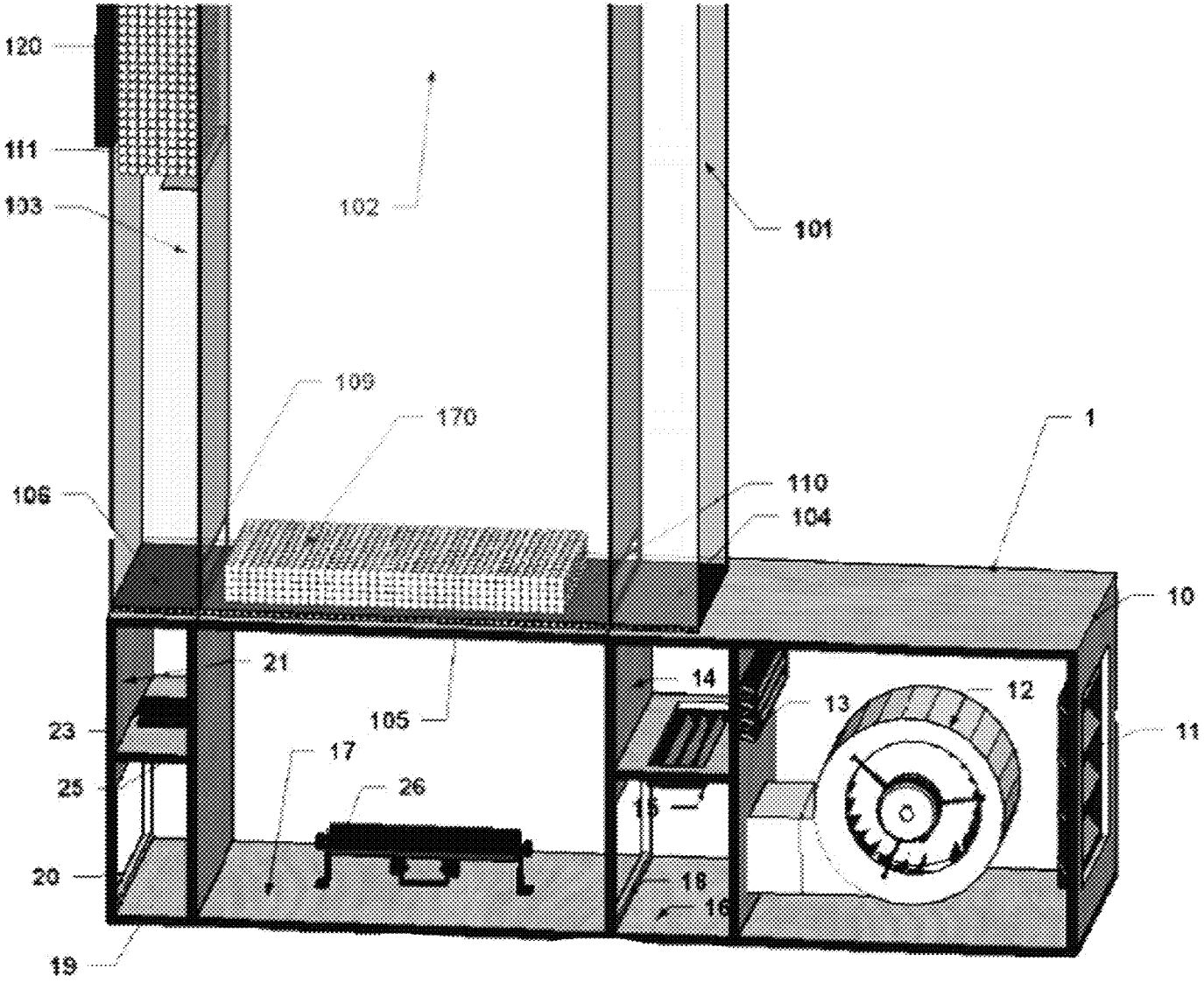
FIG. 3 is a sectional view of a closeup of the base assembly showing its various compartments and elements.

FIG. 1 shows a view of an example embodiment of the visual display device 100 composed of a base assembly 1, column assembly 2 and top cap assembly 3. The base assembly 1 may be composed of one section or multiple sections. An example embodiment has one or more fans or other means to generate an airflow through the column assembly 2 mounted on the base assembly 1. In an alternative embodiment, in place of or in addition to these fans, the top cap assembly 3 that can be mounted on the top of the column assembly 2 may also contain one or more fans to be the primary source of airflow by themselves to pull airflow up through the column assembly 2. Top cap assembly fans may also be used to alter the airflows generated by the fans located in the base assembly 1. FIG. 2 shows a front sectional view of a typical embodiment of FIG. 1. FIG. 3 shows a front sectional view of the base assembly 1 which contains different compartments and components to illustrate different individual embodiments of the current invention. The base assembly may be constructed of any suitable solid material such as for example wood, plastic, or metal. Within FIG. 3, the right fan base compartment 10 includes a damper 11 to help control airflow into the base assembly and into the column as well as to help control the amount of negative pressure in compartment 10 versus the ambient air outside the base assembly. Damper 11 can be implemented in many different ways known to those skilled in the art to create a controllable airflow obstruction between the inside and outside of the box to create a pressure drop from the outside of the box to the inlet of fan 12. Fan 12 is shown as a centrifugal blower; however, any type of blower or fan can be used here such as propeller, axial, mixed flow, inline, computer cooling fan, etc. Although this fan 12 could be a fixed speed fan it would be advantageous that this fan as well as any other fan used in the preferred embodiments also has the capability to vary its speed. Many different mechanical and electronic approaches are well known by those skilled in the art to vary the speed of any fan used in an embodiment of this invention. For example, an inline centrifugal blower could be used with an electronically commutated DC motor that is controlled with its variable speed controller thorough, e.g., a 0 to 10 Volt analog or digital control signal. A small computer cooling fan for example, can be controlled with a PWM (Pulse Width Modulated) control signal whose pulse width can be varied to change the speed of the motor. Note that for the purposes of this invention the term, airflow control device, is defined as being either a fan or damper device that can be used to vary the air volume of the first and second airflow streams.

Fan 12 discharges into compartment 16 which feeds the small compartment 14. Compartment 16 is also linked to the larger compartment 17 through opening 18. The larger compartment 17 feeds air into the larger center column 102 through a screened opening 105. The screening material can be made of any suitable material such as plastic or metal that can pass air without letting out the particle material or beads 170 contained in the main column 102. Typically, this screening material will have a hole diameter or opening that is smaller than the diameter of the smallest beads being used in the visual display device. Beads can be any relatively lightweight, small material with a density of less than about 1 gram/centimeter$^3$ (gm/cm$^3$) and preferably of spheroid shape. In some embodiments, common expanded polystyrene (EPS) beads such as those used in "bean bag" chairs having a size between 2 and 5 millimeters with a density of about 0.016 to 0.022 gm/cm$^3$. However, for very large displays a larger expanded polystyrene bead size such as up to about 13 mm or larger may be preferred. To enhance the visual effects, light 26 can be used to illuminate the underside of the column. Other lights can also be used to illuminate the front and sides of the columns. Light 302 in the top cap 3 can be used to shine downward and illuminate beads in the columns from the top. These lights can be of any type, but LED lights whose color and intensity can be controlled either manually or digitally through DMX 512 type controls and programmed to run with a preset routine or interactively are preferred. The control of the various fans and dampers in this invention can also be controlled via DMX 512 type digital controls or through any analog, digital, networked, software, microprocessor driven, or other methods known to those skilled in the art of controlling airflows with HVAC and industrial controls.

The air moving through the larger compartment 17 into the center column 102 constitutes in this diagram a first stream of flowing air that is used to fluidize, move, and allow for the beads 170 to be lifted and floated high up into the Plexiglas column 102 to create various visual effects. Base compartments 14 and 21 illustrate two different approaches to create a second controlled source of airflow either into or out of adjacent columns 101 and 103 to control the movement of beads back into the main column 102 to among other purposes control the number of beads in column 102. Varying the number of beads 170 in the main column 102 dramatically changes the visual effects of the display unit making it very advantageous to be able to quickly and easily vary the number of beads in the main display column 102.

Compartment 14 illustrates one means to either cause beads 170 in side column 101 to flow into main column 102 or to "freeze" the beads and prevent them from flowing into the main column 102. This is accomplished through the use of dampers 13 and 15. Damper 13 which can be any controllable opening or damper connects compartment 14 to the inside of compartment 10 which is connected to the inlet side of fan 12. As such, the inside of compartment 10 will be at a negative pressure with respect to both the ambient air outside of the base assembly 1 but also to the main column 102. This negative pressure will pull air out of side column 101 through screened opening 104 into compartment 14 and then into compartment 10. This negative pressure and airflow out of column 101 is controllable by damper 13 but will also be affected and can also be adjusted by changing or controlling the negative pressure in compartment 10. This can be done to some extent by increasing the flow through fan 12 but also to a more significant extent by partially closing off damper 11 or a combination of both actions. Some of these actions regarding at least damper 11 can also be done without significantly affecting the first stream of airflow into the main column 102. For example, depending on the type of fan and where fan 12 is operating on its flow versus static pressure fan curve, damper 11 can be closed partially to increase the negative pressure in compartment 10 without major changes in the flow through fan 12 that is providing airflow into main column 102. Alternatively, assuming fan 12 has some variable speed control, the speed of fan 12 can be varied to provide the same flow into main column 102 to compensate for desired changes in the negative pressure in compartment 10 due to changing the opening of damper 11 to assist in creating a negative pressure in compartments 10 and 14 to pull air out of column 101.

The impact of the negative pressure and flow in column 101 is that some beads will flow into column 101 from main column 102 through the lower side opening 110. More importantly, assuming there is enough airflow in the main column 101, more beads 170 will move to the top area of the main column 102 and be pulled into the side column 101 through upper side opening 115 of FIG. 2. These beads 170 will fall down into the side column 101 and accumulate. This action can be further accelerated by at least partially closing top cap dampers 303 so that more of the main column airflow is diverted and exhausted through the side column 101. Using a sidewall opening in column 101 similar to that shown as screened opening 107 in side column 103 can also help move more airflow and beads into side column 101. The lower side opening 110 will be rapidly blocked as the beads pile up and are sucked down onto the screened opening 104. The beads are being sucked downward by the negative pressure and downward airflow and are effectively frozen in place. This allows a lot of beads 170 to be stored into side column 101 allowing the quantity of beads 170 in the main column to be reduced to the desired level. Assuming enough negative pressure, substantially no beads will flow out of the side column 101 into the main column 102 through opening 110 no matter how many beads accumulate in side column 101.

When it is desired to move the beads 170 back into the main column 102, damper 13 can be closed and damper 15 can be fully or partially opened. This will change the pressure in compartment 14 from negative to positive since damper 15 connects compartment 14 to compartment 16 which is on the discharge side of fan 12 and thus at a positive pressure with respect to the ambient air outside the base assembly 1. The positive pressure in compartment 14 will push airflow into and upwards through side column 101 which will change the state of those beads 170 from being frozen in place to being in a fluid state since this column 101 and its beads 170 will become and act as a fluidized bed. The beads in this state act like a fluid and will then quickly flow through opening 110 back into the main column. Assuming there is also positive airflow in the main column 102, so this column and its beads are also in a fluidized state, the beads of the side column 101 will flow into the main column 102 until the height of beads in the side column is at approximately the same height as the beads 170 in the main column 102. This action is no different than what happens when two columns containing liquids of different heights are suddenly connected together through an opening, conduit, or tube. At that point the liquid will flow from one column to the other until the columns contain liquids at the same height. Due to the principles of fluidized beds where beds of particles with air flowing through them will act like a liquid, the beads will self-level themselves between the two columns as if they were actually liquids not a large number of solid particulate matter.

Figure 4:
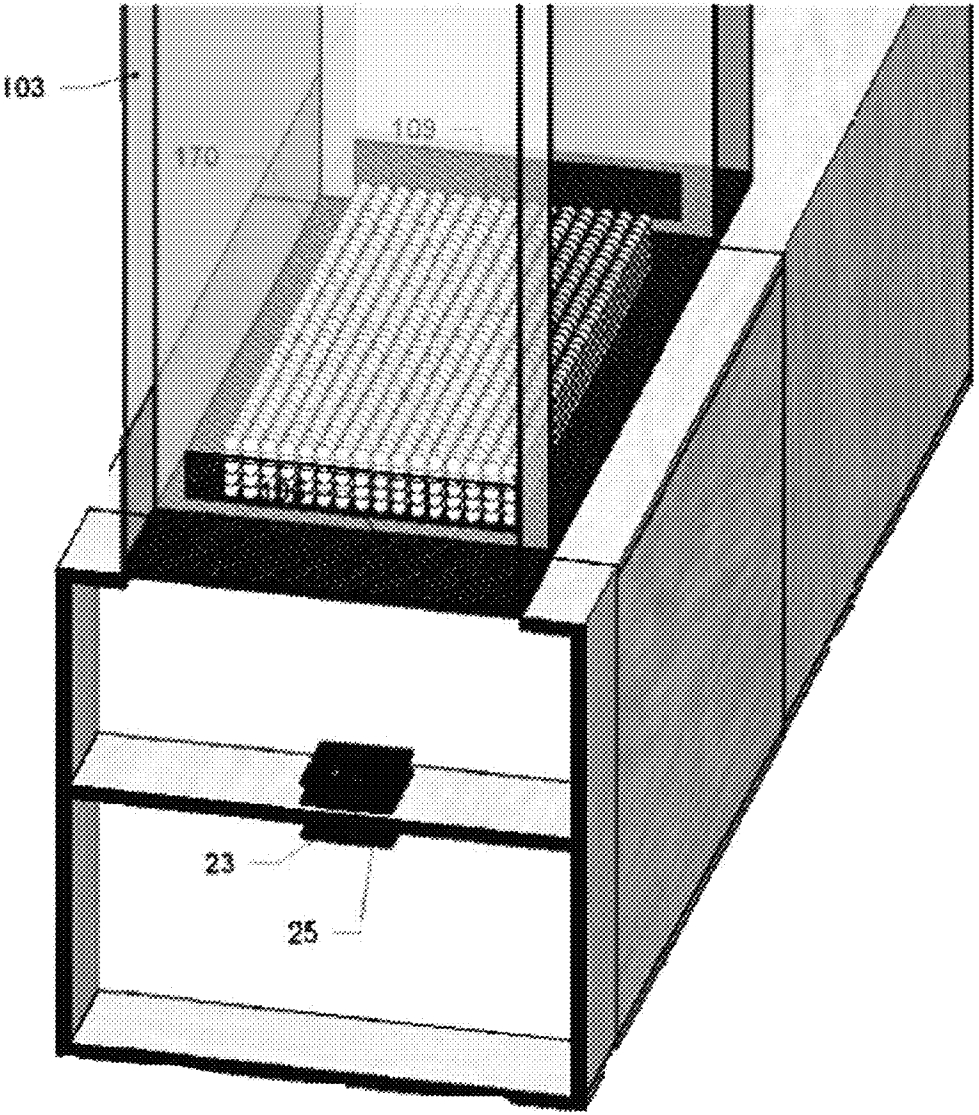
FIG. 4 is a sectional view of a closeup of the end of the leftmost compartments of the base assembly showing various fans and dampers used to control the flow in the leftmost column.
Figure 5:
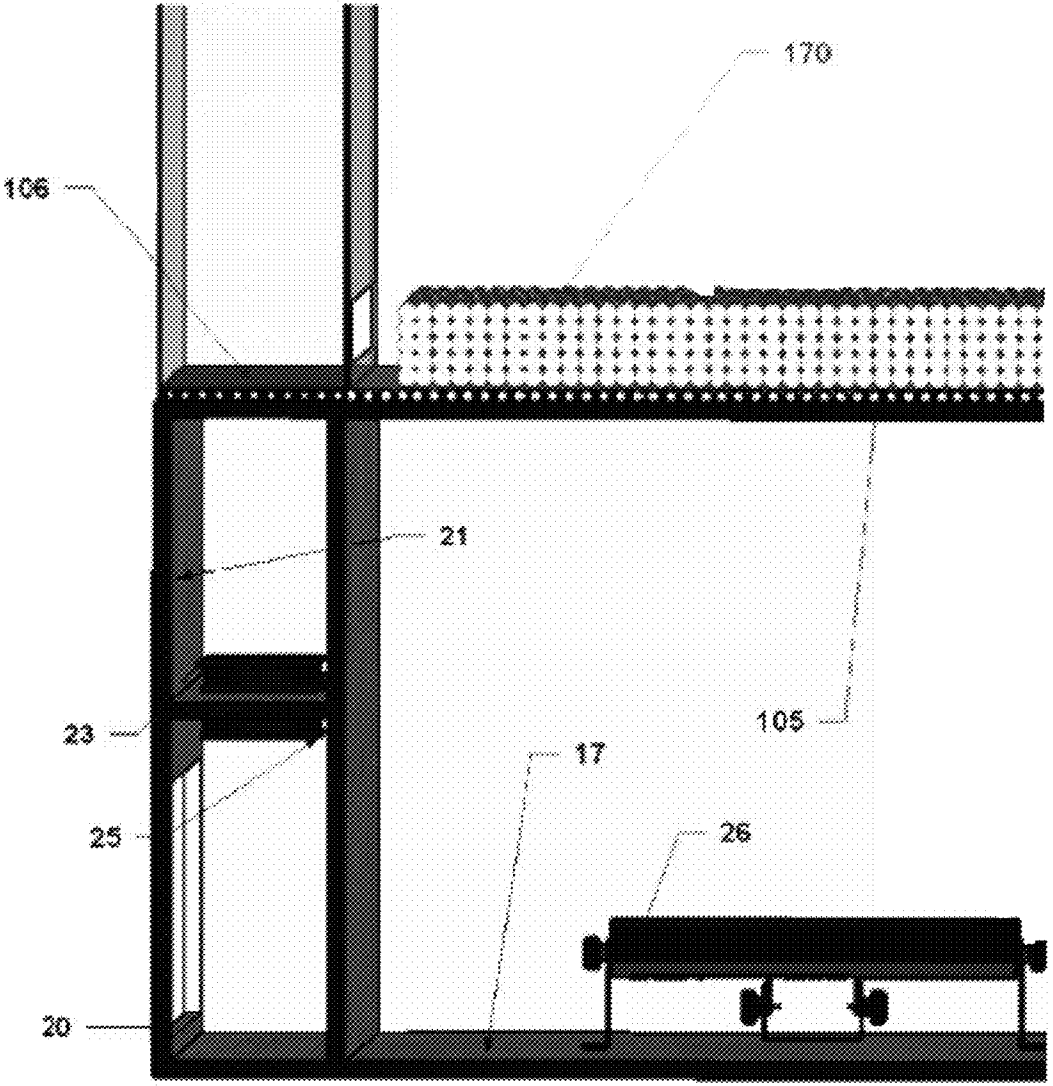
FIG. 5 is a sectional view of a closeup of the front of the leftmost compartments of the base assembly showing various fans and dampers used to control the flow in the leftmost column.

An alternative embodiment to generating this second stream of controlled airflow to move or freeze the beads 170 is shown in FIGS. 4 and 5 which show different sectional views of base compartments 19 and 21 which are not connected to any of the other base compartments. The fans 23 and 25 are shown in the preferred embodiment as small computer or "muffin" cooling fans, but any other fan types known to those skilled in the art can also be used. In this embodiment base compartment 21 is placed in either a negative or a positive pressure and flow by one or more of a combination of fans 23 and 25. One method of generating the negative and positive pressure and flow is shown in FIGS. 4 and 5. This approach uses fans 23 and 25 to generate either an upward or downward flow by putting compartment 21 in a positive or negative pressure respectively. Using two fans side by side would not work since when one fan was running to generate either an upward or downward flow the other fan would act as a relief port and much of the turning fan's flow would escape through the other fan and much less flow would go into the right side column 103. One approach to solve this problem is to stack one fan directly on top of the other with either the two fan inlets facing each other or the two fan outlets facing each other. For the typical computer cooling fan, slightly less acoustic noise and slightly better airflow performance will be generated by having the two outlets face each other. The two fans don't necessarily need to be in contact with each other but can instead be separated by some distance as long as the volume space between the two fans is totally enclosed so no flow can leak in or out. An alternative to this approach might appear to be to replace the two fans 23 and 25 with a single fan such as in the location of fan 23 that would have the capability to provide both forward and reverse flow. However, these fans are not as common as the simpler, unidirectional fans 23 and 25 and typically don't have the same level of flow and static pressure performance capability due to compromises in the blade design necessary to allow operation with similar flows in either direction. Therefore, the novel approach of using the two fans stacked on top of each other provides a slightly more expensive but much better performing solution. Another solution to the approach of two side by side fans and the nonworking fan acting as a relief port is to put a controlled damper at the inlet or outlet of each fan to block flow when the fan is not being used. Sometimes this is known as a backdraft damper although in this case it is to prevent "forward draft" flows or flow in the fan's forward or normal flow direction. In some embodiments, a controlled damper is used in this manner to prevent relief flow or "forward flow" through each fan when it is not running. These dampers, like any of the dampers in this inventions such as dampers 11, 13, and 15 could be manually controlled but the preferred embodiment would have some type of electric, electronic, or pneumatic damper operator that can move to open or close the damper or position it in a two state or variable manner based on an electronic analog or digital command signal. A fan can be used to provide upwards flow or a positive pressure in compartment 21 by mounting it with its outlet facing upwards. Another fan would then be mounted with its outlet facing downward or in the opposite direction so as to provide downward flow by putting compartment 21 under a negative pressure. Typically, only one fan would be operating at one time to generate either upward or downward flow. For example, if a fan is providing downward flow then a relief damper would be open and the second fan would be off and its relief damper would be closed.

The bead motion in column 103 is similar to the action in column 101 with airflow either entering or leaving the column through screened opening 106 and beads 170 moving into side column 103 from main column 102 from either a lower column opening 109 or upper column opening 116. When air is moving downward through screened opening 106 the beads 170 will be frozen and unmoving at the bottom of side column 103 with no beads moving out of lower column opening 109. When positive or upwards airflow is moving through screened opening 106 as well as through screened opening 105 of the main column 102 then the beads 170 will flow into or out of the side column 103 until the height of the beads 170 in the main column 102 and side column 103 is approximately the same height.

Figure 6:
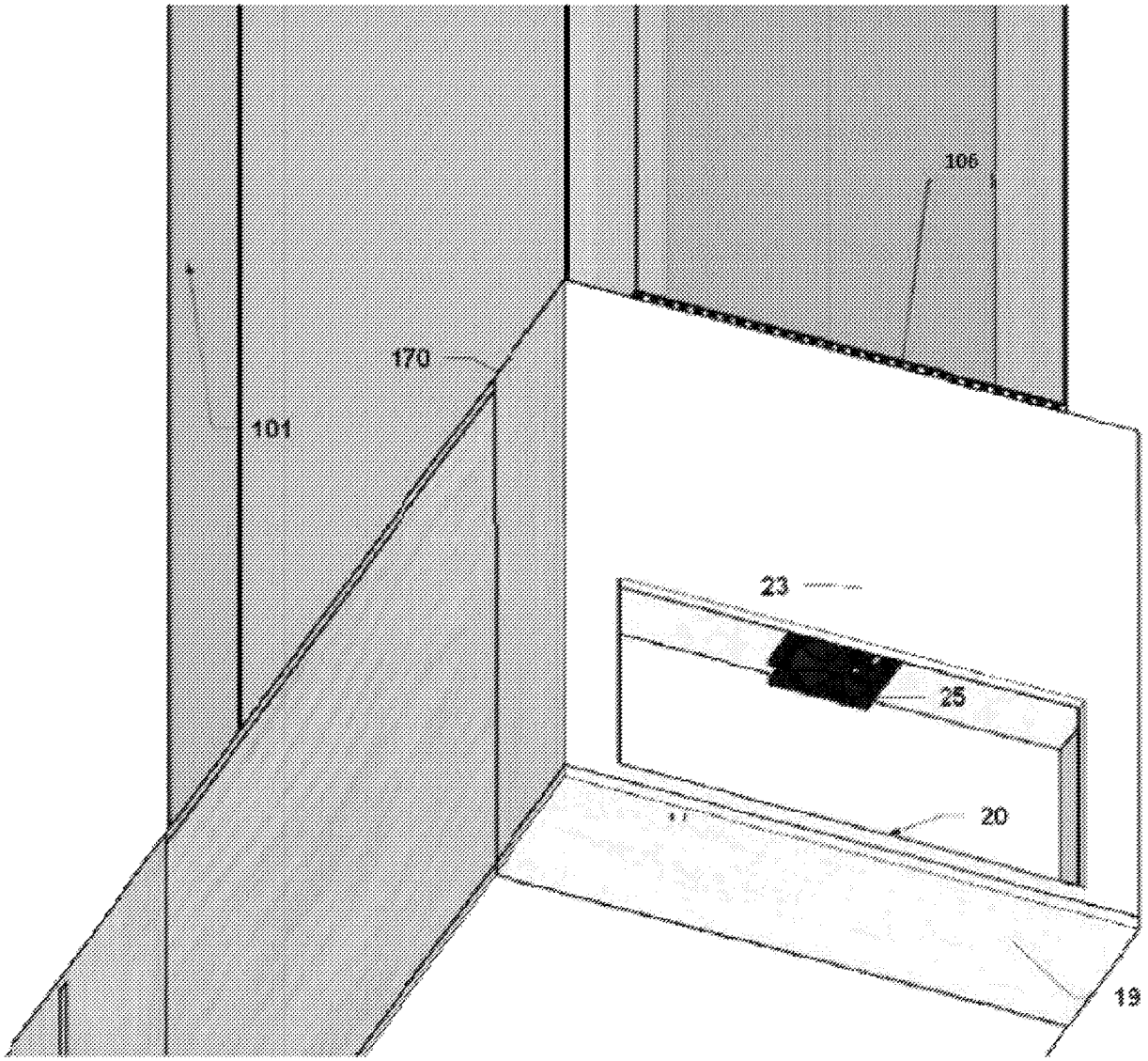
FIG. 6 is a view of a closeup of the end of the leftmost compartments of the base assembly showing various fans and dampers used to control the flow in the leftmost column as seen through the opening of the bottom leftmost base compartment.

FIG. 6 shows a non-sectional view of the fan 25 which is located in compartment 19 as seen through opening 20.

Figure 7:
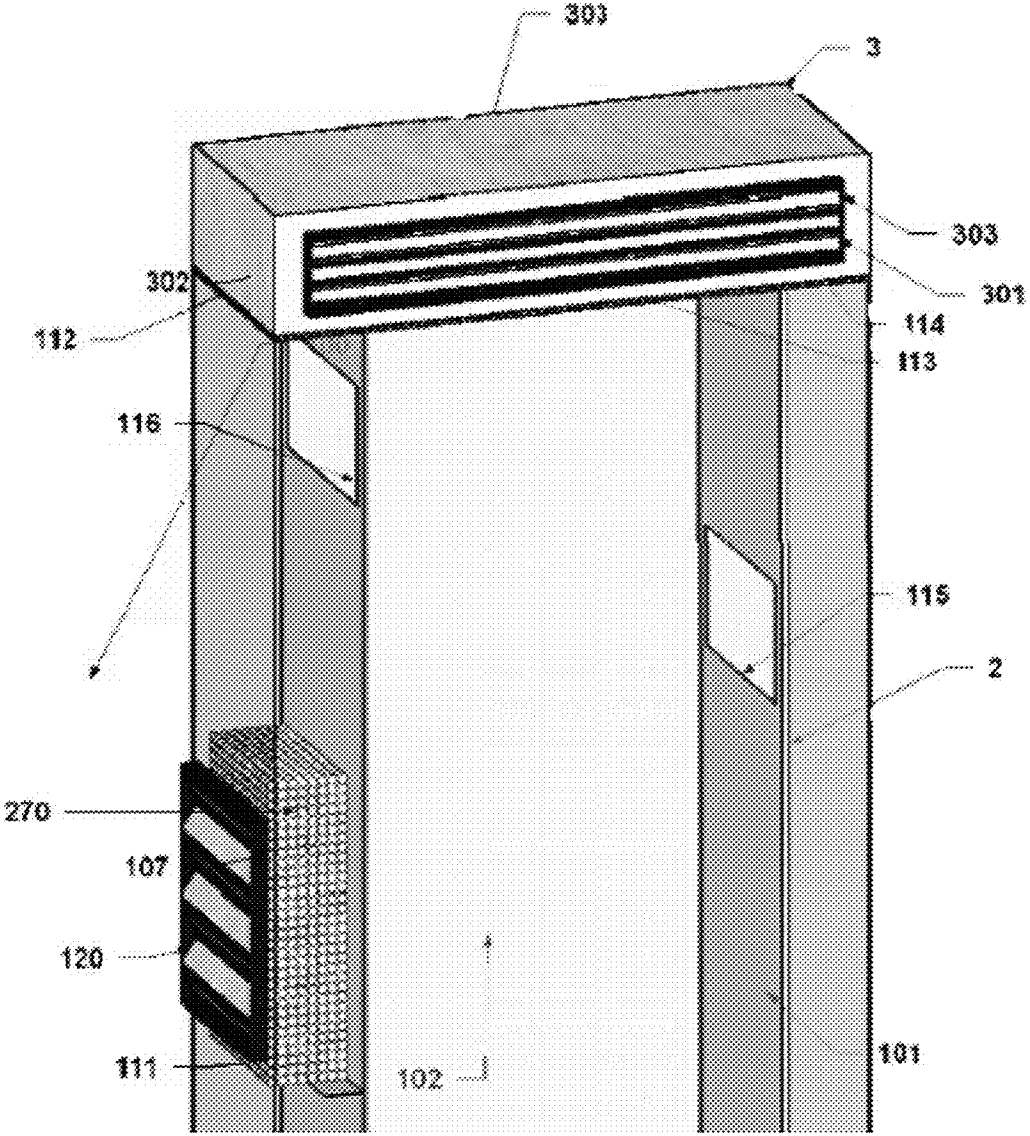
FIG. 7 is a view of the center of the column assembly with a plug of beads shown frozen in the middle of the left most column.

FIG. 7 shows another means to generate and or control a second stream of air to freeze the movement of beads 170 in a conduit. Side column 103 has a screened opening 107 through which air can exit. If air is entering the side column either through bottom screened opening 106 or through the opening 116 in the main column, it can leave the column through this screened opening 107. This second stream of airflow, if of a sufficient volume, will pull beads 170 that are in side column 103 against the screen 107 collecting more and more beads as time goes on. If enough beads 170 are in the side column and the flow of air out of the screened opening 107 is high enough, the beads 170 will collect on the screen to not only cover the surface of the screen but also collect and freeze a large mass of beads that can stretch to the other side of the side column or conduit 103. This effectively creates a "plug" of beads 270 that are frozen in place in the conduit or column 103. In some embodiments, with an airflow through the screen in the range of at least about 200 to 400 fpm, the beads will form a plug 270 that will prevent beads from moving up or down past the plug. This plug 270 can be made strong enough that it will defy gravity to create an interesting visual effect as shown in FIG. 7. One method of creating the visual effect of this plug 270 in FIG. 7 is to first create a negative pressure in the bottom of side column 103. This will freeze the beads 170 at the bottom of side column 103 and prevent them for flowing into the main column 102. If the airflow in main column 102 is then increased beads 170 will flow up and many of the beads 170 will flow into through opening 116 into side column 103. These beads 170 will accumulate and start to fill side column 103. When enough beads have filled side column 103 to beyond the height of the screened opening 107 the airflow through the screened opening 107 can be increased through one or more of the methods described below. Increasing the flow through the screened opening will freeze the beads 170 in the vicinity of the screened opening 107. If the airflow is then reversed at the bottom of side column 103 so air flows up into the bottom of side column 103 then the beads at the bottom of side column 103 will fluidize and flow into the main column through opening 109. This will cause all the beads 170 below plug 270 to flow down and into the main column 102 creating the effect shown in FIG. 7 with a large empty space below the bead plug 270. Adding more beads into the top of side column 103 from the main column 102 will accumulate even more beads 170 into side column 103 above the plug 270 with the plug holding the beads above it in place. This is an interesting and unexpected visual effect with a large mass of beads appearing to defy gravity by not falling down without any easily visible means holding them up. However, once the airflow through the screened opening is reduced the beads 170 will then fall and allow beads 170 to once again flow continuously through the side column or conduit 103 and into the main column 102, for instance through opening 109.

There are many ways to control the intensity and strength of this frozen bead or plug effect, all being related to controlling the second stream of flowing air out of the screened opening 107. First of all, varying the flow rate through the main column by varying the flow through fan 12 has a major impact as this is the majority of the air that will flow through the screened opening 107. Some of the air moving through the screened opening 107 can also come from the bottom of side column 103 or be reduced by a negative source of air pulling air out of the bottom of the side column 103. More importantly, a damper 120 can be used as shown in FIG. 7 to vary the effective open area of the screened opening to independently vary the airflow through the screened opening 107. Alternatively, or in addition to what is shown, a fan could be added in front of or instead of the damper 120 to pull more airflow through the side screened opening 107. Another means to assist in controlling the airflow through the side screened opening 107 is to operate top cap relief dampers 303 located on the front and back of the top cap assembly 3 covering top cap relief openings 301. If these dampers 303 are closed off or reduced in open area then the air exiting the main column 102 into the top cap 3 through screened opening 113 and out of the top cap 3 through relief openings 301 will be restricted or shut off. Similarly, any flows from side columns 101 and 103 into the top cap 3 and out relief openings 301 will be restricted or shut off as well. As a result, all or a larger portion of the main and side column's airflow can be forced through side column 103 and out the side screened opening strengthening the plug effect.

By varying the amount of air exiting through side screened opening 107, the number of beads 170 pulled and accumulated next to the screened opening 107 can also be varied. This results in a variable obstruction or equivalently a variable opening on the far side of this conduit or side column 103 which will vary the rate at which beads can fall through this opening between the frozen beads and the side of the column. This results in different and varied visual effects as the number of beads flowing down the column can be varied. Again, all these volume control and blocking actions are accomplished without any material obstruction or damper in series with the beads 170 that might crush or harm the beads over time.

One additional element to make forming a plug of beads 270 more easily is shown in FIG. 7 as shelf 111. This shelf extends out from the opposite or far wall of side column 103 opposite the screened opening 107. This shelf helps to form a plug of beads 270 by obstructing a portion of the side column 103 on the side opposite the screened opening 107 where it is more difficult to hold the beads in a frozen state since it is farthest from the screened opening 107. The beads will accumulate on the shelf and it will hold them up assisting in the formation of a plug of beads with much less flow needed through the screened opening 107. The shelf does provide some obstruction to the airflow moving through side column 103 when a plug of beads is not desired, however the shelf does not have to stick out to far from the wall as even one or two inches of extension from the wall will help to hold the beads in place without them falling out of the plug.

Figure 8:
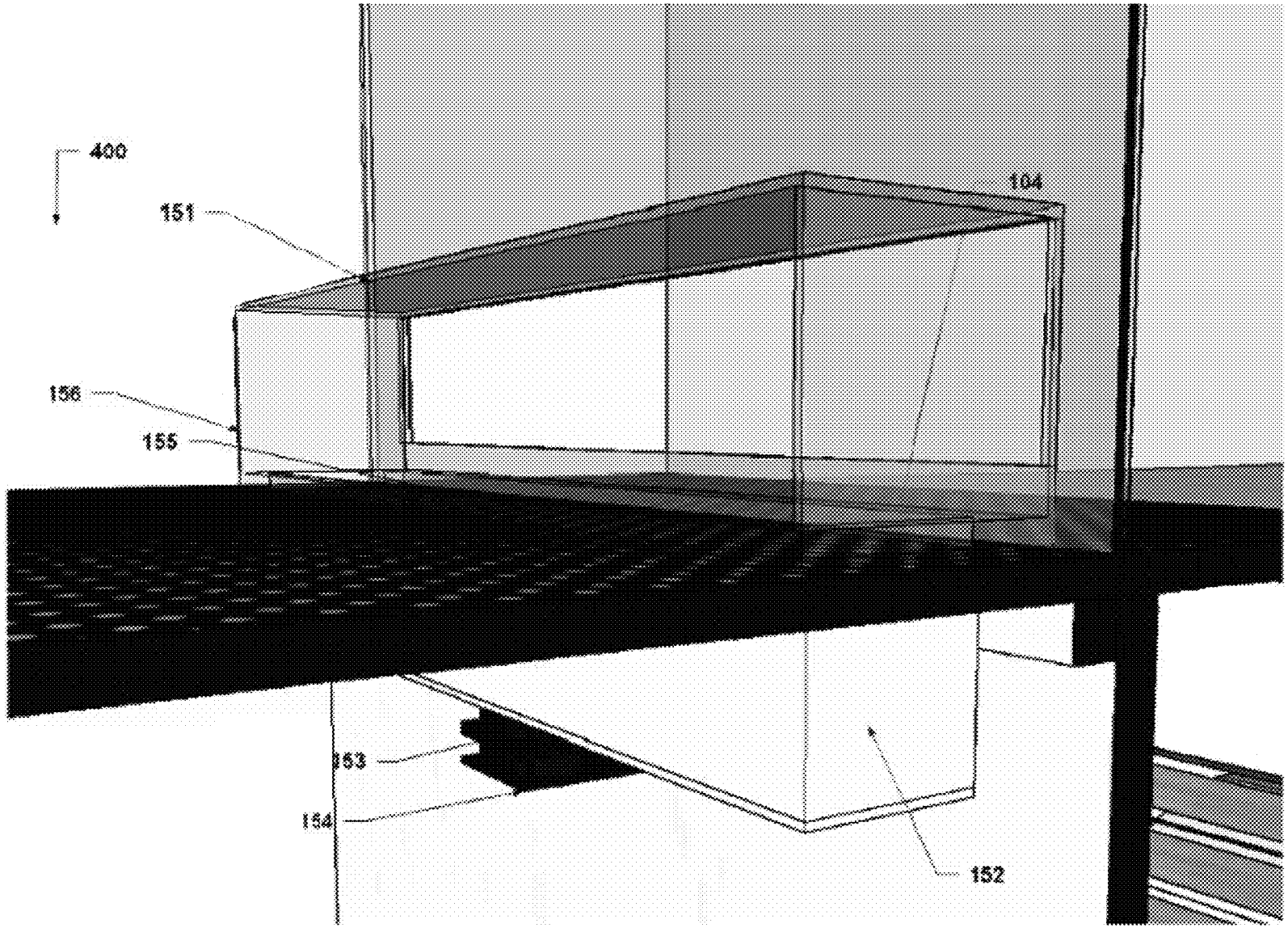
FIG. 8 is a sectional view of a short conduit of another embodiment of the visual display device (400) configured to control the flow of beads between two adjacent columns.

The embodiments discussed previously can be used to freeze the beads in a column either at the bottom of the column or at some other point in the column to prevent the beads from flowing into another column. However, it would also be desirable to be able to prevent beads from flowing from one column to another without having to partially or completely obstruct the movement of beads in a column thereby preventing or at least limiting its use to show visual effects. FIG. 8 shows an embodiment of the visual display device 400 that can stop or control the flow of beads from one column to another without significantly affecting the flow of beads in the two columns and impeding their visual effects. This independent ability to control the flow of beads between two columns is implemented using a second stream of controlled airflow flowing into or out of a short tube or conduit 151 that connects the two columns 101 and 102. The short conduit 151 is connected on one side to opening 110 between columns 101 and 102. The short conduit 151 is shown located at the bottom of column 102 but could also be located in column 101 or in a slightly different embodiment at some height above the bottom of either column. The short conduit or tube 151 that is shown in FIG. 8 has its other opening 156 discharging into column 102. To either enable the flow of beads through the short conduit 151 or to freeze beads in the conduit, a second stream or source of airflow is provided through screened opening 155. This second airflow stream can be generated by one of the several approaches previously described using various dampers and fans. FIG. 8 shows a preferred embodiment with a plenum chamber 152 that connects fans 153 and 154 to the entire area of screened opening 155. Two fans 153 and 154 are shown with one of the fans used to pull air down through screened opening 155 to freeze beads in short conduit 151 and the other fan used to provide air up into short conduit 151 to enable the flow of beads 170 between columns 101 and 102. Also as described for fans 23 and 25, fans 153 and 154 could have their outlets or inlets facing each other but with the outlet configuration slightly preferred for acoustic and performance reasons. Alternatively, a single reversible fan with the ability to provide both forward and reverse flow could be used instead of the two fans 153 and 154. The short conduit 151 and opening 110 can be of any size and does not need to extend over the entire width or even the majority of the width of column 101 and 102. Depending on how fast it is desired to flow beads 170 from one column to the other, this opening 110 and short conduit 151 can be made relatively small to minimally impact the visual effects of either column. Additionally, unless the length of short conduit 151 is more than about 3 to 6 inches, a positive airflow stream may not be required to enable at least some bead flow through short conduit 151 due to the air that will enter the tube naturally from columns 101 and 102. As such for these shorter tube applications only a single fan 153 may be used to just pull air out of the short conduit 151 to block bead flow and freeze beads 170. When this negative airflow is switched off, and if positive airflow is flowing in both columns 101 and 102 then enough airflow from these columns will flow into the short conduit 151 to at last partially fluidize the beads 170 in this short conduit to cause flow between the two columns 101 and 102. The bead flow rate will be faster if positive airflow is provided through screened opening 155, but depending on the application and visual effects desired it will likely be sufficiently fast for many applications without need for this positive airflow stream.

Figure 9:
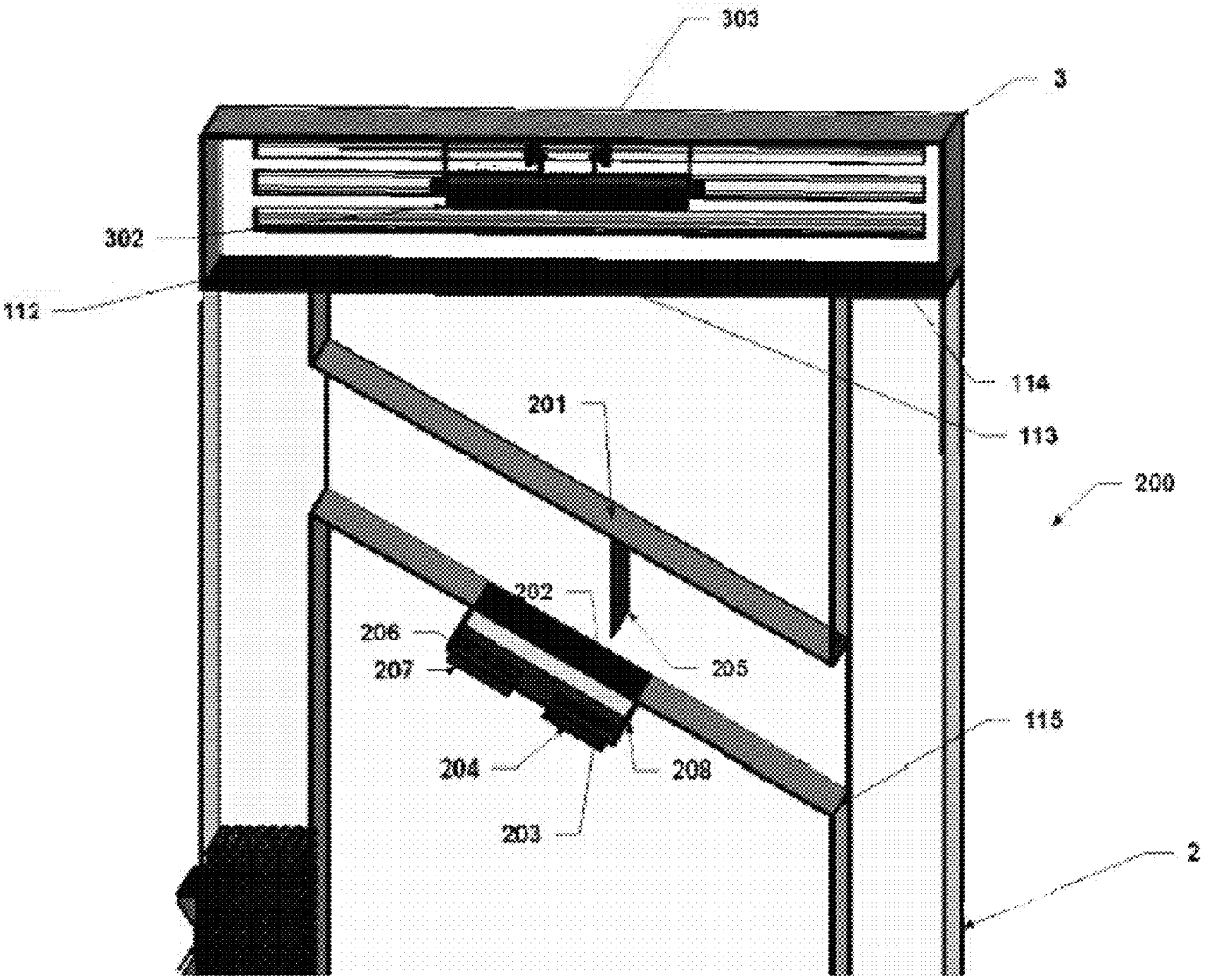
FIG. 9 is a sectional view of a long sloping conduit of another embodiment of the visual display device (200) configured to control the flow of beads between two columns or areas of the visual display device.
Figure 10:
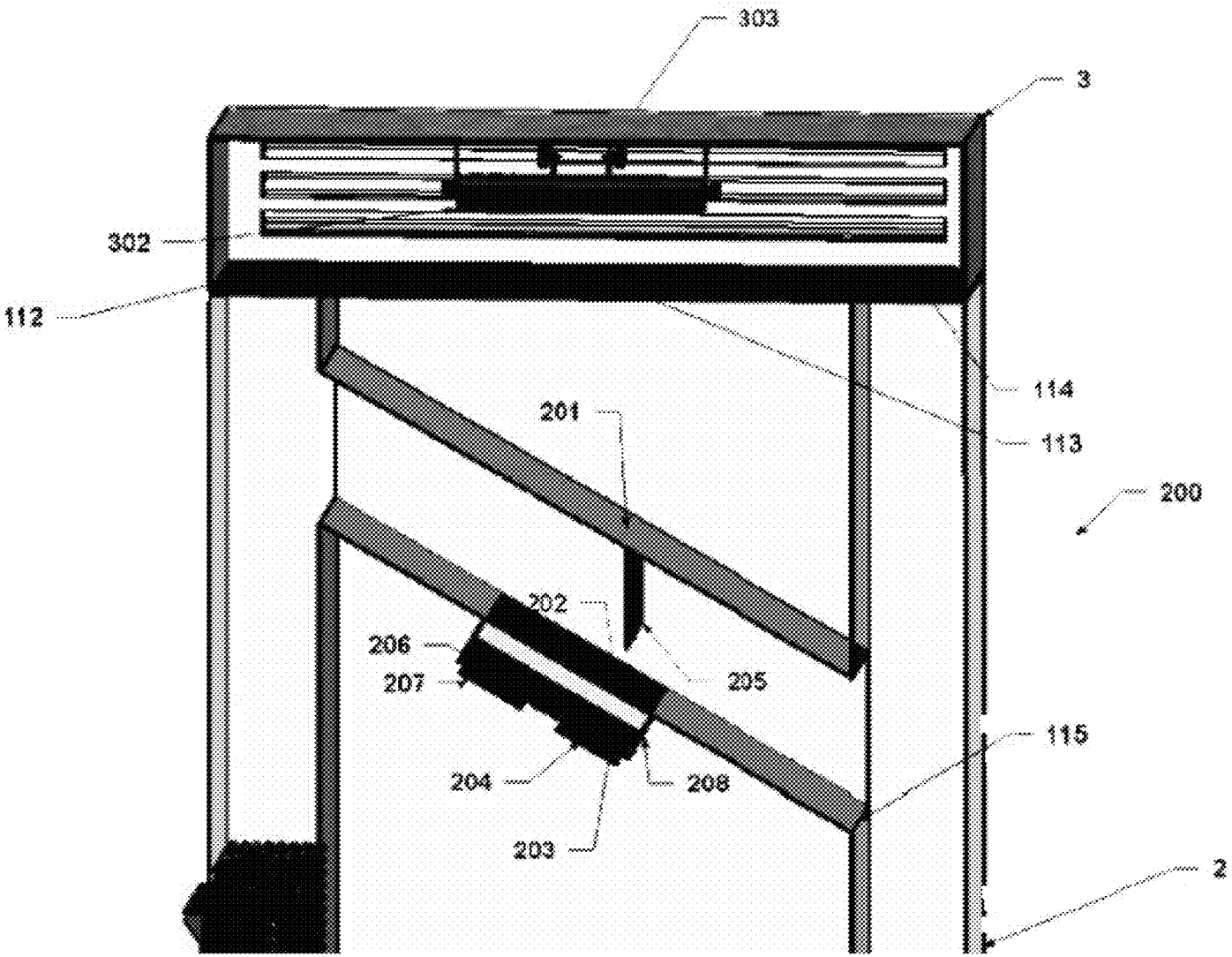
FIG. 10 is a sectional view showing the inside of the long sloping conduit that can control the flow of beads between two columns or spaces.

An embodiment of the visual display device 200 for controlling airflow through a conduit with a second airflow stream is shown in FIGS. 9 and 10. FIG. 9 shows a sectional view of the top of the columns 101, 102, and 103 with a conduit 201 connecting columns 103 to 101. FIG. 9 shows conduit 201 within main column 102, however conduit 201 does not need to be within another column for the purposes of this embodiment. Conduit 201 could as well have been located outside of any columns in an empty space between the two columns it is connecting. In FIG. 9, conduit 201 is shown with one of its open ends coincident with side column 103's opening 116 located above the other open end which is coincident with column 101's opening 115. Because of this difference in height beads naturally will flow via gravity from column 103 to column 101 assuming no major difference in air pressures or flows between these two columns. However, if there is sufficiently more air pressure in column 101 than 103 then bead flow can also move up conduit 201 against gravity almost as an extension of column 101 with its greater air pressure. In such a positive pressure situation depending on the length of conduit 201 and the air pressure difference between the two columns, conduit 201 may even be horizontally mounted and beads 170 will still flow between the two columns. To control or stop the flow of beads 170 between columns 101 and 103 regardless of whether gravity or air pressure is moving beads 170 between the two columns, a second stream of controlled negative air flow out of conduit 201 may be used. FIG. 10 shows a sectional view of an embodiment to create this second air stream including screened opening 202. This opening 202 is shown in the preferred embodiment with a location on the bottom of conduit 201 near its center, however screened opening 202 could also be located on any of the four walls of the conduit and could as well be located near the top or lower end of the conduit 201. To create this second stream of airflow, a plenum box 208 is attached to conduit 201 to enclose the screened opening 202 and connect it to either a fan 204 through opening 203 or alternatively a damper 207 through opening 206. The fan 204 is used to create a negative pressure in plenum box 208 to draw airflow from conduit 201. This airflow draws beads 170 towards screened opening 202 to immobilize them and freeze them on and around the screened opening 202. With enough negative airflow a plug of beads can be formed in conduit 201 to block the flow of any beads though it. An alternative to the use of fan 204 is to use damper 207 to create a negative or exhaust airflow through screened opening 202 by utilizing the positive pressure in columns 101 and 103 similar to the operation of damper 120 and screened opening 107 as discussed previously. Again, in addition to the opening of damper 207, the relief dampers 303 in the top cap 3 can help to create a larger negative flow through screened opening 202 by helping to force more airflow from exiting out the top cap to instead exiting out through the screened opening 202. The operation of the fans and dampers in the base unit 1 that are driving flow through columns 101 and 103 can also influence this second airflow stream through screened opening 202 by also influencing the positive pressure and airflow in the center conduit 201. Note that this positive pressure will also influence the flow through the screened opening 202 when the fan 204 is used but to a lesser extent than when damper 207 is used.

FIG. 10 shows a sectional view of conduit 201 that also shows shelf 205 that can help to form a plug of beads in conduit 201 similar to the action of shelf 111 as described previously by providing a partial obstruction in conduit 201. Shelf 205 can be made of any solid material to provide a means to partially block the flow of beads 170. The size, placement and orientation of shelf 205 can be varied to provide a reasonable obstruction to beads 170 while still allowing beads to flow through the conduit when there is less flow or no flow through screened opening 202.

Figure 11:
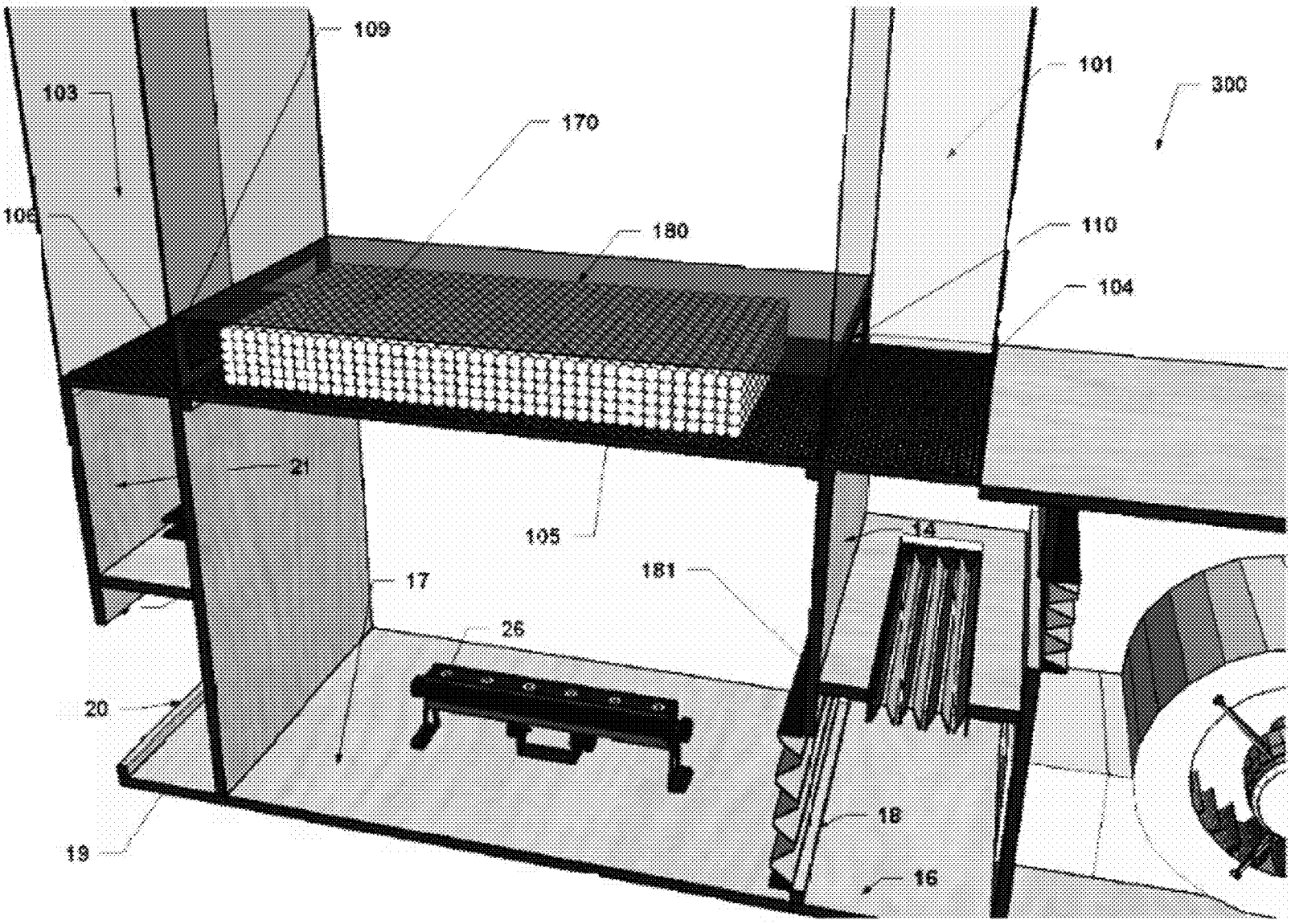
FIG. 11 is a sectional view of a long horizontal conduit of another embodiment of the visual display device (300) that can control the flow of beads between two columns or spaces of the visual display device.

FIG. 11 shows a sectional view of a longer horizontally mounted conduit 180 in an embodiment of the visual display device 300 that connects columns 101 and 103 where column 102 is not present. This conduit has a screened opening 105 thorough which air from fan 12 can pass to fluidize the beads in this conduit. By providing enough flow of air into the conduit the beads will fluidize and allow them to flow back and forth between columns 101 and 103. A damper 181 can be placed in opening 18 to control the amount of air flowing into conduit 180 from fan 12. Alternatively, damper 181 can be eliminated and control of the air in conduit 180 can be provided independent of or at least partially independent of the flow of air into column 101 by the collective and possibly interactive control of dampers 13 and 15 and also fan 12 to provide different desired flows for conduit 180 and column 101.

If horizontal aligned conduits such as conduit 180 have a distance between the two end openings 109 and 104 that is greater than about 6 to 12", then a negative airflow stream through screened opening 105 may not be needed to block the flow of beads 170. This is more likely to be relevant if the air pressure between the two connected columns or spaces (such as columns 101 and 103 in this case) is not that high. For example, if the differential air pressure between the two columns is less than about 0.1" of water column pressure and there are a lot of beads in the conduit, so that at least a portion of the conduit is already blocked with beads then the beads are unlikely to flow between the two columns. In this situation the second stream of airflow may only need to have a positive pressure causing an airflow stream upward into the conduit to allow the beads to flow through the conduit. Shutting off this airflow may then be enough to stop the flow of beads without having to apply a negative pressure and airflow steam out of the conduit. For a more guaranteed bead flow blockage independent of the amount of pressure difference between the columns then another fan drawing air out of conduit 180 or else a damper connected to an area of negative pressure relative to the inside of conduit 180 can be used to provide a negative downward flow through screened opening 105 using embodiments that have been discussed previously.

One other consideration in terms of the velocity and amount of positive airflow moving into these horizontal conduit such as conduit 180 and to a lesser but still important degree with the short horizontal conduit 151 mentioned previously is that the amount of airflow and velocity through the bottom screened opening should not be excessive such as more than about 250 to 500 feet per minute. There should be enough airflow to fluidize the beads 170 but not so much as to push all the beads out of the conduit and create a positive pressure in the horizontal conduit 180 or 151 that is large enough compared to the positive pressure in the spaces or columns that are connected to that conduit such that beads will not flow easily into the conduit. Typically depending on the size, weight and density of the beads, a range of approximately 50 to 250 feet per minute of airflow velocity through the screened opening 105 will be sufficient to fluidize the beads and allow them to flow easily but not create such an excessive airflow that beads will not flow into the conduit from at least one of the spaces or columns to which they are connected.

Although specific features of the invention are shown in some drawings and not others, this is for convenience only as some feature may be combined with any or all of the other features in accordance with the invention.

As utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations. As utilized herein, the terms "about", "generally", and "approximately" are intended to cover variations that may existing in the upper and lower limits of the ranges of subjective or objective values, such as variations in properties, parameters, sizes, and dimensions. In one non-limiting example, the terms "about", "generally", and "approximately" mean at, or plus 10 percent or less, or minus 10 percent or less. In one non-limiting example, the terms "about", "generally", and "approximately" mean sufficiently close to be deemed by one of skill in the art in the relevant field to be included. As utilized herein, the term "substantially" refers to the complete or nearly complete extend or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A visual display device for creating various visual and audible effects from motions of a plurality of beads, the visual display device comprising:

a chamber with at least some portion of the chamber configured to provide a view of an interior of the chamber, and comprising a primary flow subsystem comprising a first stream of airflow configured to agitate, fluidize, suspend, or float at least some of said plurality of beads; and a bead transport control subsystem comprising a second stream of airflow controlling a flow of at least a portion of said plurality of beads through at least one conduit connecting a first region of the chamber to a second region of the chamber; wherein said second stream of airflow is controlled at least partially independently from said first stream of airflow.

2. The visual display device of claim 1, wherein said plurality of beads comprise lightweight expanded polystyrene plastic beads.

3. The visual display device of claim 1, further comprising a screened opening disposed within at least a wall or end of said at least one conduit.

4. The visual display device of claim 3, wherein said second stream of airflow passes into or out of said at least one conduit through said screened opening.

5. The visual display device of claim 4, further comprising one or more fans configured to vary at least a volume of said second stream of airflow.

6. The visual display device of claim 4, further comprising one or more dampers configured to vary at least a volume of said second stream of airflow.

7. The visual display device of claim 4, further comprising:

an airflow control device configured to control at least a volume of said second stream of airflow, wherein said second stream of airflow flows out of said at least one conduit through said screened opening; and a first subset of said plurality of beads are pulled against said screened opening or are frozen in place near said screened opening such that the first subset of said plurality of beads stops or restricts a flow of a second subset of said plurality of beads through said at least one conduit.

8. The visual display device of claim 4, further comprising:

an airflow control device configured to control at least a volume of said second stream of airflow, wherein said second stream of airflow flows into said at least one conduit through said screened opening; and said second stream of airflow is configured to fluidize or cause said plurality of beads to move through said at least one conduit.

9. The visual display device of claim 4, wherein the screened opening is on a bottom wall or bottom end of said at least one conduit.

10. The visual display device of claim 4, wherein said at least one conduit comprises a first hollow column connected to a second hollow column disposed within the chamber through a connecting opening disposed between said first hollow column and said second hollow column that is in in fluid communication with said screened opening disposed in said first hollow column such that control of said second stream of airflow controllably prevents or creates a bead flow between said first hollow column and said second hollow column through said connecting opening.

11. The visual display device of claim 4, further comprising:

an airflow control device configured to control said second stream of airflow into or out of said at least one conduit through said screened opening, wherein said airflow control device comprises:

a first damper having a first end connected to an at least partially enclosed space and also connected to an outlet of a fan wherein a second end of said first damper is configured to blow at least a portion of outlet airflow of said fan into said at least one conduit through said screened opening as said second stream of airflow; and a second damper having a first end connected to an at least partially enclosed space and also connected to an inlet of said fan wherein a second end of said second damper is configured to pull said second stream of airflow out of said at least one conduit through said screened opening into the inlet said fan.

12. The visual display device of claim 1, further comprising two or more airflow control devices wherein at least a first airflow control device of the two or more airflow control devices is configured to control said first stream of airflow and at least a second airflow control device of the two or more airflow control devices is configured to control said second stream of airflow.

13. The visual display device of claim 12, wherein said first airflow control device is further configured to exert additional control on said second stream of airflow and said second airflow control device is further configured to exert additional control on said first stream of airflow.

* * * * *